US012593920B2

(12) United States Patent
Wu

(10) Patent No.: US 12,593,920 B2
(45) Date of Patent: Apr. 7, 2026

(54) HEIGHT ADJUSTABLE TRAVEL PILLOW

(71) Applicant: Aiming Wu, Chicago, IL (US)

(72) Inventor: Aiming Wu, Chicago, IL (US)

( * ) Notice: Subject to any disclaimer, the term of this patent is extended or adjusted under 35 U.S.C. 154(b) by 202 days.

(21) Appl. No.: 18/074,476

(22) Filed: Dec. 4, 2022

(65) Prior Publication Data

US 2024/0180333 A1 Jun. 6, 2024

(51) Int. Cl.
*A47C 7/38* (2006.01)
*A47G 9/10* (2006.01)

(52) U.S. Cl.
CPC ..... *A47C 7/383* (2013.01); *A47G 9/1081* (2013.01); *A47G 2009/1018* (2013.01)

(58) Field of Classification Search
CPC ..... A47C 7/38; A47C 7/383; A47C 7/386; A47G 9/1081; A47G 2009/1018
See application file for complete search history.

(56) References Cited

U.S. PATENT DOCUMENTS

| | | | | |
|---|---|---|---|---|
| 6,230,348 | B1 * | 5/2001 | Patrikakis | A47G 9/1081 5/636 |
| 2008/0229498 | A1 * | 9/2008 | Grosso | A47C 7/383 5/244 |
| 2014/0310877 | A1 * | 10/2014 | Sternlight | A47G 9/02 5/639 |
| 2016/0029821 | A1 * | 2/2016 | Atkinson | A47G 9/1081 5/636 |
| 2017/0127858 | A1 * | 5/2017 | Teh | A47G 9/1045 |
| 2018/0132621 | A1 * | 5/2018 | Scrimshaw | A47C 16/00 |
| 2019/0282008 | A1 * | 9/2019 | Choi | A47C 7/383 |
| 2020/0214452 | A1 * | 7/2020 | DuPré | A47G 9/1081 |
| 2021/0127867 | A1 * | 5/2021 | Lee | A47C 7/383 |
| 2021/0369019 | A1 * | 12/2021 | Ambuske | A47G 9/1027 |
| 2022/0287483 | A1 * | 9/2022 | Fischenich | A47C 7/386 |

* cited by examiner

*Primary Examiner* — George Sun

(57) ABSTRACT

The present invention discloses a novel design of the height-adjustable travel pillow that provides head cushioning, and lateral support and stays in place when the user is in a seated position or semi-reclined. The travel pillow includes an inflatable system in its core which allows the user to achieve the desired thickness level to ensure maximum comfort and rest to the user.

1 Claim, 5 Drawing Sheets

HEIGHT ADJUSTABLE TRAVEL PILLOW

COPYRIGHT NOTICE

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

Field of the Invention

The present disclosure relates generally to travel pillows. In particular, travel pillows include an air-filling system for adjusting the thickness of the travel pillows to accommodate everyone's individual needs.

Description of the Related Art

Modern-day travelers may find themselves desiring to get rest while on a long flight or train ride, especially in the case of overnight flights such as redeyes, or international flights. However, airline seating is often designed with cost economy first, and passenger comfort second. Seats with limited recline make getting sleep difficult, and the small pillows provided by airlines often prove unsatisfactory as they fail to provide necessary support or are prone to slip out of position, leaving a passenger unable to get a decent sleep. Consequently, horseshoe shaped travel pillows have become a popular item for travelers, as they stay in position around a user's neck and allow a user to lean their head to one side in a relatively stable position.

Known travel pillows are not entirely satisfactory for the range of applications in which they are employed. For example, existing travel pillows are typically constructed using a roughly horseshoe-shaped outer cover which is filled with a fill material such as small Styrofoam balls, seeds or husks such as buckeyes, feathers or down, cotton or polyester batting, or other such compliant material. Some variants instead use an inflatable bladder approximately in the shape of a horseshoe, which may or may not be provided with an exterior cover. Such travel pillows are typically filled to a roughly consistent height and in some cases may be tapered on either side of the horseshoe. For many users, the travel pillow offers inadequate side support for a user wishing to lay their head to one side or another. Furthermore, some airlines have added head rests to airline seats in an attempt to improve comfort to some extent. These head rests are designed to function while the passenger is awake, and do not provide sufficient support to allow for good sleep. Moreover, they may interfere with proper usage of conventional travel pillows, decreasing comfort by creating pressure on the back of the neck by pressing into the travel pillow at its thickest point and by extension pushing the user's head forward uncomfortably.

By looking at prior art multiple advancements have been seen in travel pillows. For instance, a U.S. patent application Ser. No. 12/171,014 for a Pillow to Provide Direct Head, Neck, Jaw and Chin Support, and To Relax Cervical and Shoulder Muscles, filed by Yang, teaches a neck-support pillow comprising a resilient pillow body having a column-shaped medial portion and two cantilever arms. The Yang Application does not disclosure or teach a design for a travel pillow that has concave sections in the upper and lower arm elements to provide for positional stability of the travel pillow while also allowing the user to comfortably wear headphones.

A, U.S. patent application Ser. No. 13/488,443 for a Travel Pillow with Lateral and Rear Support Bar and a Flat and Thin Back, filed by Sternlight et al., teaches a U-shaped travel pillow having a base cushion and raised cushion fixed to the top side of the base cushion. The Sternlight et al. application similarly does not disclose or teach a pillow design that incorporates any concave sections to provide for positional stability while being used. Instead, Sternlight et al. teaches an ergonomic raised design to provide lateral support for the user's head and neck.

A U.S. patent application Ser. No. 20/180,146,807A1 for a form fitting travel pillow having a unique shape that provides positional stability in relation to the wearer's shoulders, and further allows for comfortable use of headphones, is disclosed. The travel pillow is formed with upper and lower concave sections such that the lower concave section fits over and conforms to the wearer's shoulders, while the upper concave section is formed such that the wearer can comfortably wear headphones. In one preferred embodiment, the travel pillow may also include a front snap or latching element to assist in maintaining a proper position of the pillow. The travel pillow may be manufactured from memory foam, and may also include a removable cover that can be readily washed or cleaned. In one embodiment, the travel pillow may also include an attached pocket or bag into which the travel pillow may be easily stowed.

A U.S. patent application Ser. No. 10/548,405B2A discusses a travel pillow with a chin extension for additional support to keep a user's head from falling forwarded while sitting in an upright or reclining position in a high-backed chair, such as those on an airplane, train, automobile, or bus. The travel pillow comprises a parabolic U-shaped cushion, with sides that minimize lateral head movement, a forward chin extension adds extra support for the chin and head, an extension on each of the rear end of the side panels that curve around the rear shoulders, and a means of fastening the open side panels together behind the neck to ensure that the pillow cannot fall forward, away from the user.

A U.S. patent application Ser. No. 81/449,13B1 discusses travel pillow with audio system. Described is a traveling pillow having embedded headphones for providing a traveler with a comfortable place for resting the neck and head and music to the ears. A universal plug can be located within a pocket of the pillow to permit connection to the headphones and a location for storing an MP3 player, iPod® or cellular phone with music files. Alternatively, a separate plug is provided and accessible from the exterior of the pillow should the traveler desires to use an audio cord and place the music storage device elsewhere, or to connect a Walkman®, Discman®, laptop or DVD player to the pillow headphones. A volume control knob permits the traveler to set an appropriate volume level to provide his or her favorite music in surround sound and total comfort.

There are multiple solutions that have been presented in the prior art. However, these solutions are limited and restricted to their conventional architecture, and installation system and have considerable shortcomings which adversely affect the convenience with which they can be used. The prior systems have certain limitations including the design of assemblies which make them not suitable for every type of user. Moreover, the ease-of-use ability of these assemblies is also questionable.

It has to be noted that the current invention proposes an assembly with multiple advancements including a structure with symmetrical measurements in height and side width that make it more stable and easier to be used by the user. The central inflatable system helps people to adjust the pillow as per their neck size and their comfort. The assembly is made of high-density memory foam to allow maximum comfort and convenience to the user.

None of the previous inventions and patents, taken either singly or in combination, is seen to describe the instant invention as claimed. Hence, the inventor of the present invention proposes to resolve and surmount existent technical difficulties to eliminate the aforementioned shortcomings of prior art.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

The primary desirable object of the present invention is to provide a novel and improved form of a travel pillow with a unique inflation system allowing users to adjust pillow thickness as per their requirements.

It is another objective of the invention to provide a travel pillow that provides support against a user's chest, is easy to adjust to a custom fit, is easy to stow and carry, is resistant to changes in cabin temperature and pressure, and is breathable.

It is further the objective of the invention to provide a travel pillow in accordance with the teachings of this invention which is compact, simple to use and is small enough to be carried in a handbag or lady's purse.

It is also the objective of the invention to provide a device whereby providing a shell of unitary construction, that is versatile, and has a compact configuration, which allows for conventional carriage in standard-size luggage.

It is also the objective of the invention to provide a travel pillow for providing the head and neck alignment of a human user resting against a seat back. The travel pillow has an interior shell with an air-filling system that allows air to be filled as per the user's required comfort level.

It is further the objective of the invention to provide a travel pillow, which prevents undesired slippage or movement while sleeping in a vertical or near-vertical position.

It is another objective of the invention to provide an improved travel pillow, which is versatile, easy to manufacture, secure in its use, comfortable and adaptable to the needs of the user.

A still further object is to provide an assembly that is economical in cost to manufacture.

Other aspects, advantages and novel features of the present invention will become apparent from the detailed description of the invention when considered in conjunction with the accompanying drawings.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention and explain various principles and advantages of those embodiments.

Figure 1A:
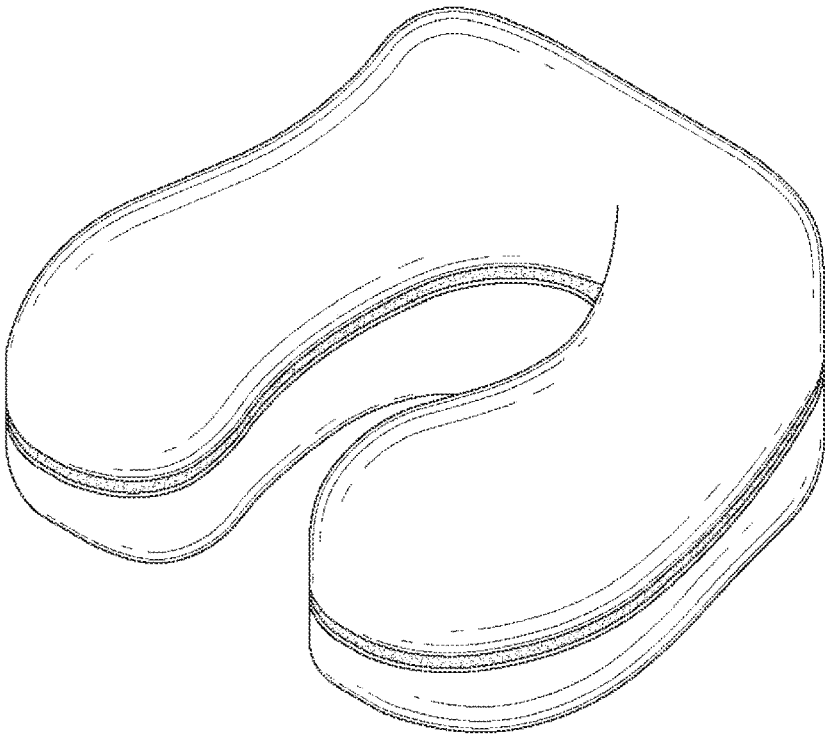
FIG. 1A shows the front view of height adjustable travel pillow as per preferred embodiments of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Air travel is becoming increasingly ubiquitous and accessible due to the availability of low-cost flights and increased air routes being served by airlines across the globe.

The U.S. Department of Transportation's Bureau of Transportation Statistics (BTS) reported in 2014, that U.S. airlines and foreign airlines serving the United States carried an all-time high of 848.1 million system-wide (domestic and international) scheduled service passengers, which was 2.5 percent more than in 2013 and 1.2 percent more than the previous record-high of 838.4 million reached in 2007.

Internationally, commercial passenger airlines logged 50.9 million flight hours with nearly twenty-four million departures and over 2.8 billion passengers fly for an average of over 2 hours per departure. At any given moment, there are approximately 690,000 passengers in the air. The trend is only increasing. Global air passenger traffic grew by 6.5% in 2015 as a whole, well above the 10-year average annual growth of 5.5%.

Unfortunately, air travel also comes with increasing health concerns, particularly, regarding back and neck pain associated with airline seating. While seat comfort is a subjective issue, the effect that poorly designed airline seats have on posture is undeniable.

It is well known by those in the industry that undue stress is placed on the human body when subjected to static positioning over long periods of time. People complain about neck pain only second to headaches. Neck pain is most likely due to poor posture. Multiple studies suggest that a substantial number of people experience increased neck pain following a flight. For frequent travelers, or those who have prior neck issues may find that putting their posture under pressure may result in a higher risk of long-term neck problems.

A major factor in travel-related neck discomfort is the seats themselves. The majority of coach seats have no adjustments for lumbar support. As well, the tops of the seats push the head forward, forcing the body into an awkward posture and causing strain on the neck muscles.

Neck problems are particularly acute for those passengers attempting to sleep on flights. Without head and neck support, passengers find themselves lolling to the side or falling forward, putting additional acute strain on the neck and upper vertebrae. However, this acute strain can result in gradual and long-term effects on posture.

For those few airlines that have seats with some type of headrest mechanism, they rarely support the head to the extent necessary to avoid neck strain. Experts suggest that passengers move around the cabin, but that is not always possible due to air conditions such as turbulence or during service times by airline flight attendants. Passengers in center seats have additional concerns due to the inability to lean to the side as can be done in window seats or being able to stretch their legs as with aisle seats. Many international flights have a 5-seat center configuration where middle-seat passengers have additional difficulties leaving their seats.

It is suggested that sitting at a 135-degree angle places the least pressure on the vertebral discs and associated structures; however, that level of recline is rarely available on current coach airplanes, although some first-class cabins, particularly trans-continental flights, include seats that recline for sleeping.

To alleviate neck pain, passengers have turned to various neck pillows, which claim to add additional head support alleviating pain and discomfort while traveling. The present invention is directed to a height-adjustable travel Pillow which allows an individual to adjust the thickness of the pillow as per his/her individual requirement.

Figure 1B:
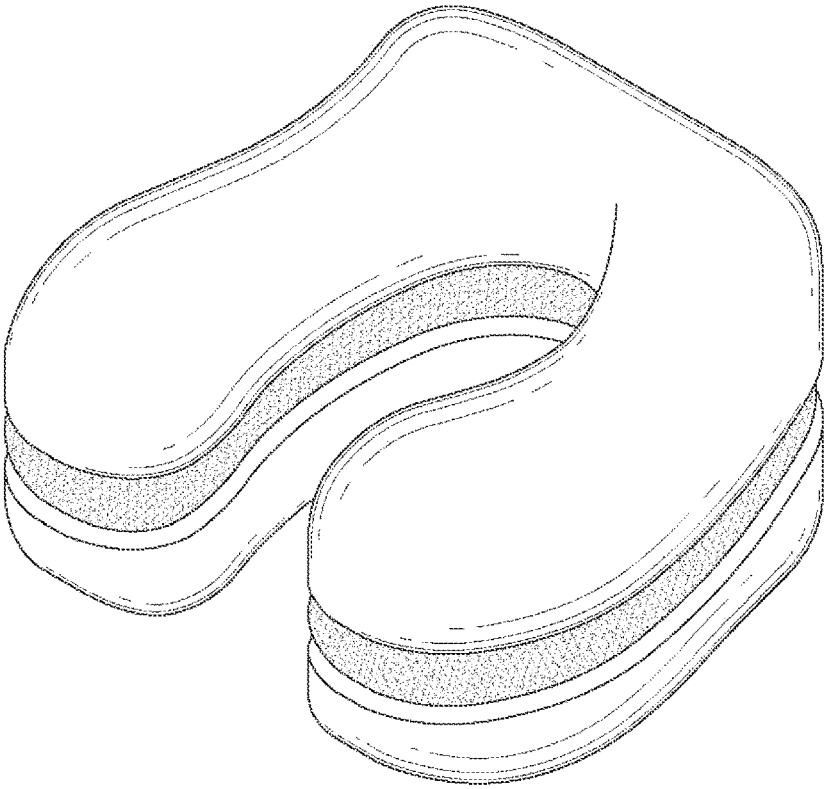
FIG. 1B shows the side view of the assembly as per preferred embodiments of the invention.
Figure 2A:
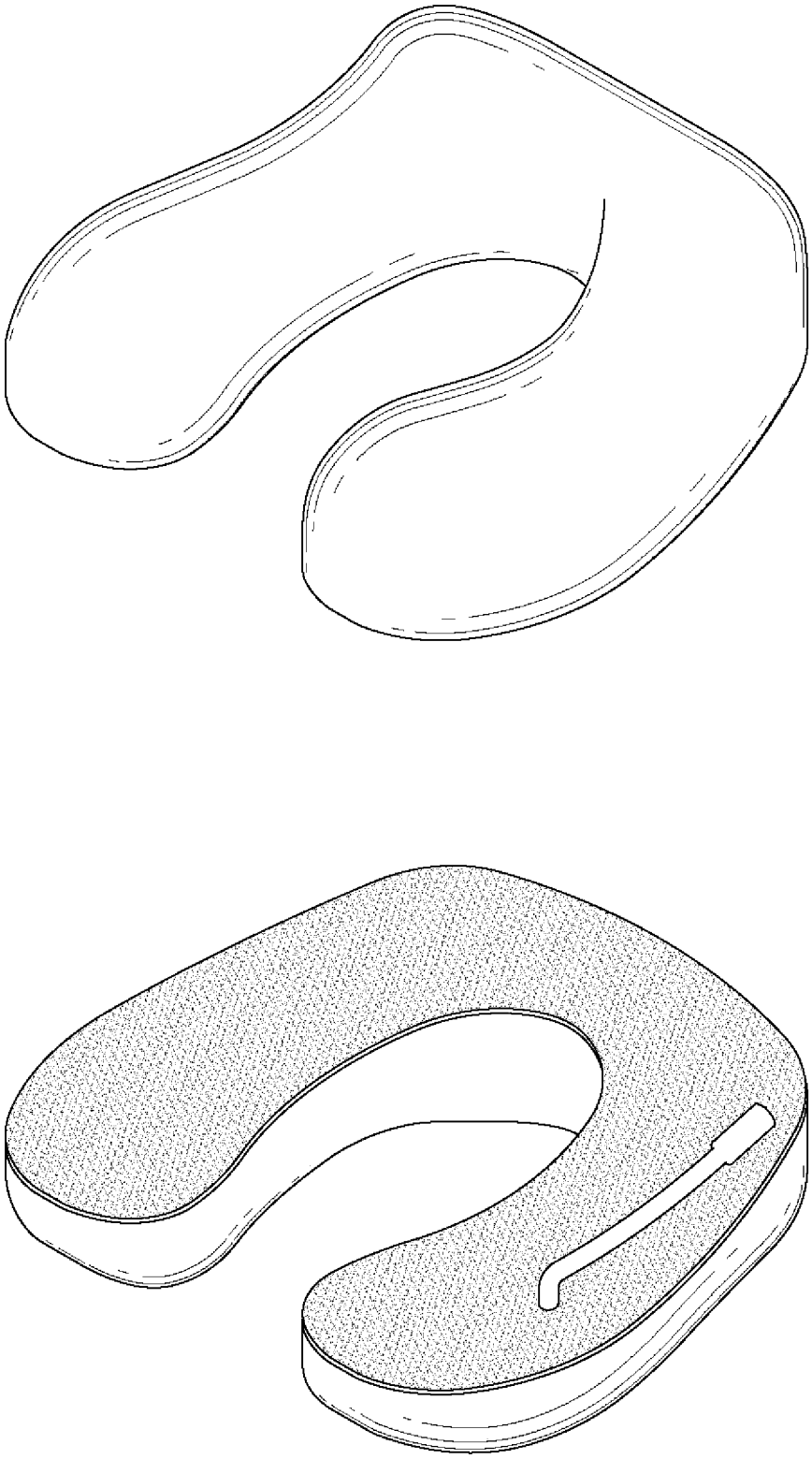
FIG. 2A shows the anterior part and air-filling part as per preferred embodiments of the invention.
Figure 2B:
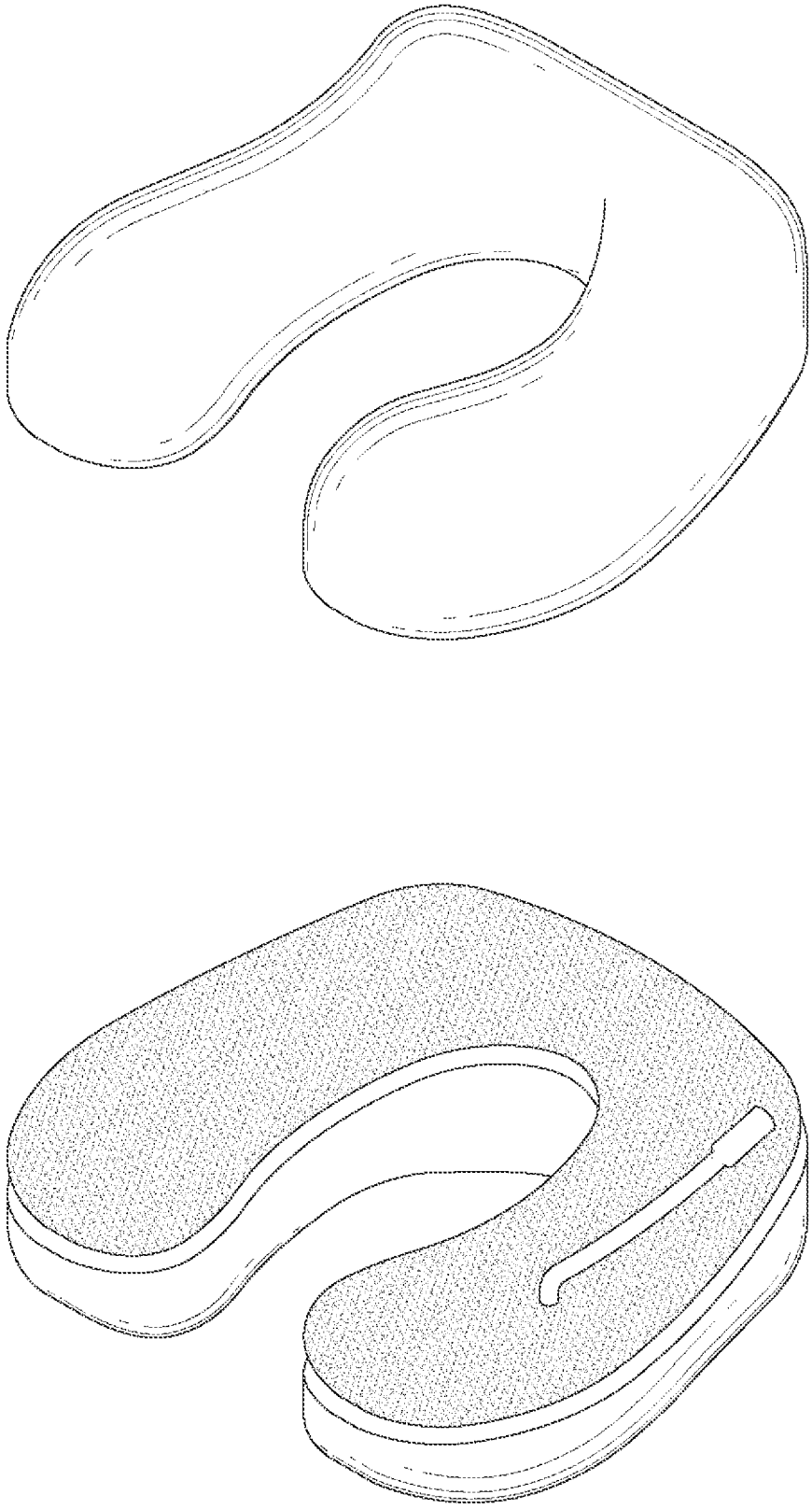
FIG. 2B shows another view of assembly internal configuration per preferred embodiments of the invention.
Figure 3A:
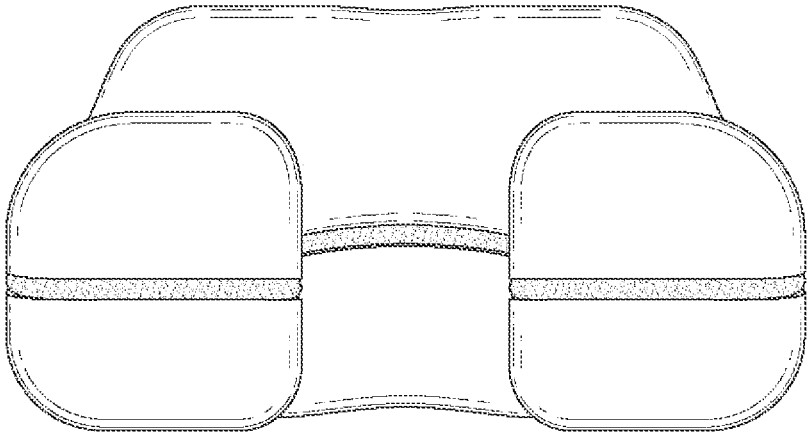
FIG. 3A shows the minimum thickness level of the travel pillow as per the preferred embodiments of the invention.
Figure 3B:
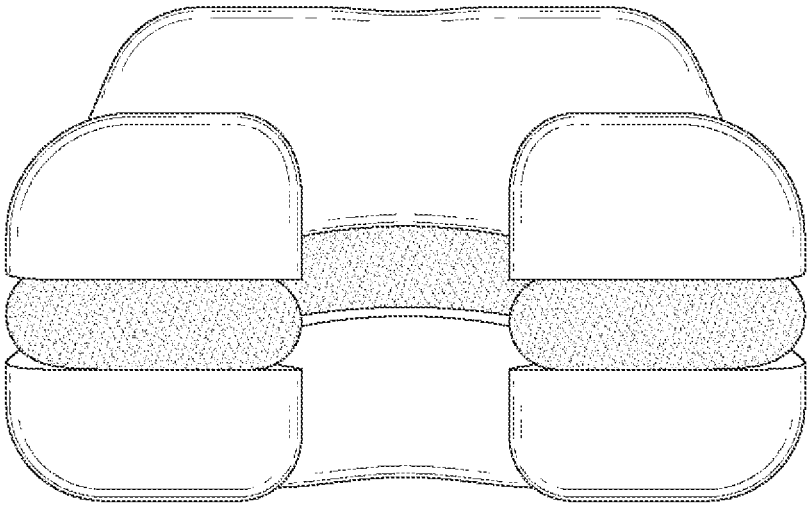
FIG. 3B shows the increased thickness level of height adjustable travel pillow as per the preferred embodiments of the invention.
Figure 4A:
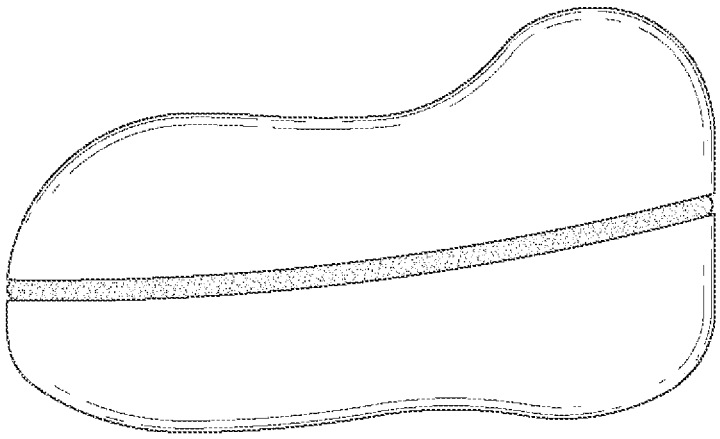
FIG. 4A shows a side view of the minimum thickness level of the height-adjustable travel pillow as per the preferred embodiments of the invention.
Figure 4B:
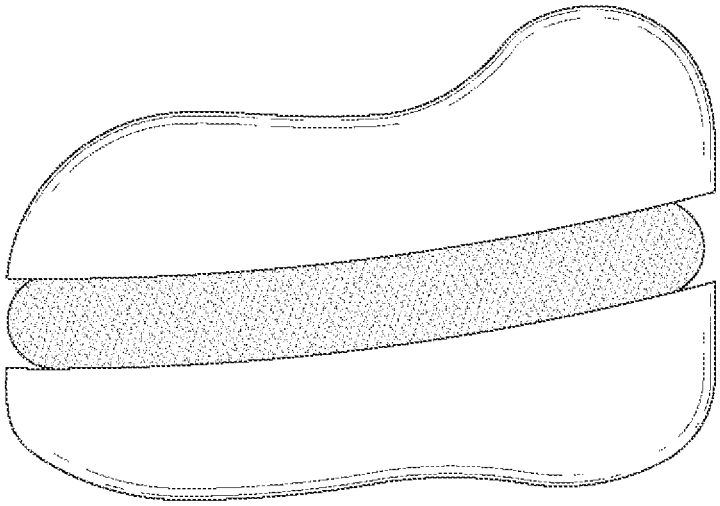
FIG. 4B shows the side view of the increased thickness level of height adjustable travel pillow as per the preferred embodiments of the invention.

In a core embodiment, as illustrated in FIGS. 1A, 1B 2A, 2B, 3A, 3B, 4A, and 4B, the travel pillow has three integrally formed sections: two arms and a back section formed into a unitary generally "U-shaped" pillow. The arms and back section forming the "U-shaped" pillow create an interior opening such that the pillow may easily and comfortably encircle the user's neck area and support the user's head in an approximately upright position. The pillow should be manufactured from a pliable, soft material that is comfortable when a user wears the travel pillow around his or her neck, and yet is firm enough to provide support to the user's head and neck.

In a key element of the disclosed innovation, the internal structure of the pillow consists of a unique blowing system allowing the user to adjust the thickness level as per personal comfort level. Each of the pillow arms is molded and manufactured to have a concave shape, on both the top and bottom of each arm. The concave shape at the bottom of each pillow arm allows the pillow to fit over the shoulder area of the user and provides positional stability for the pillow in relation to the user's shoulders and head. In other words, with the concave shape on the bottom of each pillow arm, the pillow will not rotate, twist, or inadvertently move out of position. Similarly, each pillow arm has a concave shape on the top of each arm. The concave shape on the pillow arm top allows the user to wear headphones, or other larger fully enclosed ear covers, without the pillow pushing the headphones out of position on the user's ears.

The height-adjustable travel pillow may be manufactured from different types of compressible foam, such as memory foam, low-resilience or viscoelastic polyurethane foam, or polyethylene foam, or other cushionable materials. Memory foams provide excellent cushioning and support for the user and are designed to return to the original shape and curvature when not in use or under external pressure.

While a specific embodiment has been shown and described, many variations are possible. With time, additional features may be employed. The particular shape or configuration of the platform or the interior configuration may be changed to suit the system or equipment with which it is used.

Having described the invention in detail, those skilled in the art will appreciate that modifications may be made to the invention without departing from its spirit. Therefore, it is not intended that the scope of the invention be limited to the specific embodiment illustrated and described. Rather, it is intended that the scope of this invention be determined by the appended claims and their equivalents.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A height-adjustable travel pillow comprising:

a U-shaped body including two arms and a back section made from memory foam or viscoelastic polyurethane foam, wherein each of said arms is molded and manufactured to have:

a concave shape on a bottom of each arm that allows the pillow to fit over a shoulder area of a user and provides positional stability for the pillow in relation to the user's shoulders and head such that the pillow will not rotate, twist, or inadvertently move out of position, and a concave shape on a top of each arm that allows the user to wear headphones or other larger fully enclosed ear covers without the pillow pushing the headphones out of position on the user's ears;

an inflatable bladder positioned within a central portion of the U-shaped body and embedded as a middle layer between upper and lower layers of compressible foam within the body, the bladder being:

positioned and embedded within the body, and not designed to be removed or replaced by a user, configured to expand primarily in a vertical direction upon inflation to increase the overall height and firmness of the pillow and provide enhanced head support, and manually inflatable by a user having a protrusion that extends past an edge of the pillow for direct user inflation;

wherein the inflatable bladder is integrated such that the pillow maintains its basic functionality when the bladder is not inflated;

wherein the central portion of the U-shaped body specifically houses the inflatable bladder to provide height adjustment; and wherein the vertical expansion of the inflatable bladder increases the height of the pillow.

* * * * *